United States Patent [19]

Gress

[11] 4,306,383

[45] Dec. 22, 1981

[54] GRINDING WHEEL WITH ENERGY ABSORBING DEVICE

[75] Inventor: Paul W. Gress, Sayre, Pa.

[73] Assignee: Ingersoll-Rand Company, Woodcliff Lake, N.J.

[21] Appl. No.: 124,130

[22] Filed: Feb. 25, 1980

[51] Int. Cl.[3] ..... B24B 41/04

[52] U.S. Cl. ..... 51/168

[58] Field of Search ..... 51/168; 411/544, 535, 411/531

[56] References Cited

U.S. PATENT DOCUMENTS

| | | | |
|---|---|---|---|
| 1,404,339 | 1/1922 | Bockshe | 51/168 |
| 2,544,096 | 3/1951 | Laughlin | 51/168 |
| 2,806,331 | 9/1957 | Hoye | 51/168 |

FOREIGN PATENT DOCUMENTS

| | | | |
|---|---|---|---|
| 52-14291 | 2/1977 | Japan | 51/168 |
| 569441 | 8/1977 | U.S.S.R. | 51/168 |

*Primary Examiner*—Roscoe V. Parker

*Attorney, Agent, or Firm*—Walter C. Vliet

[57] ABSTRACT

An energy absorbing device in the form of an energy absorbing washer for use in mounting grinding wheels to grinder spindles. The device is capable of absorbing energy at an initial lower rate and a final higher rate.

2 Claims, 4 Drawing Figures

GRINDING WHEEL WITH ENERGY ABSORBING DEVICE

BACKGROUND OF THE INVENTION

Rotating grinder wheels contain considerable energy especially at the higher speeds provided by recent advances in grinding wheel manufacture. In the event of sudden loss of rotation resulting, for example, from bearing failure or in the case of air motors, vane breakage, the energy of the rotating wheel must be dissipated in some manner to avoid further damage to the grinder spindle, grinder motor, grinder wheel, and as a safety precaution to prevent possible operator injury.

The object of this invention is to provide an energy absorbing device for mounting grinding wheels which is capable of absorbing substantial amounts of energy in a two-step action. A further object of the invention is to provide a simple, reliable and economical method of energy absorption. These and other objects are obtained in an energy absorbing device comprising: A first cylindrical section, a second conical section attached to and mounted in circumferential attachment at one end of the first cylindrical section, the conical section being convex to the cylindrical portion and the conical section being provided with a bolt hole through its apex for mounting to the spindle of a grinder.

DESCRIPTION OF THE PREFERRED EMBODIMENT

Figure 1:
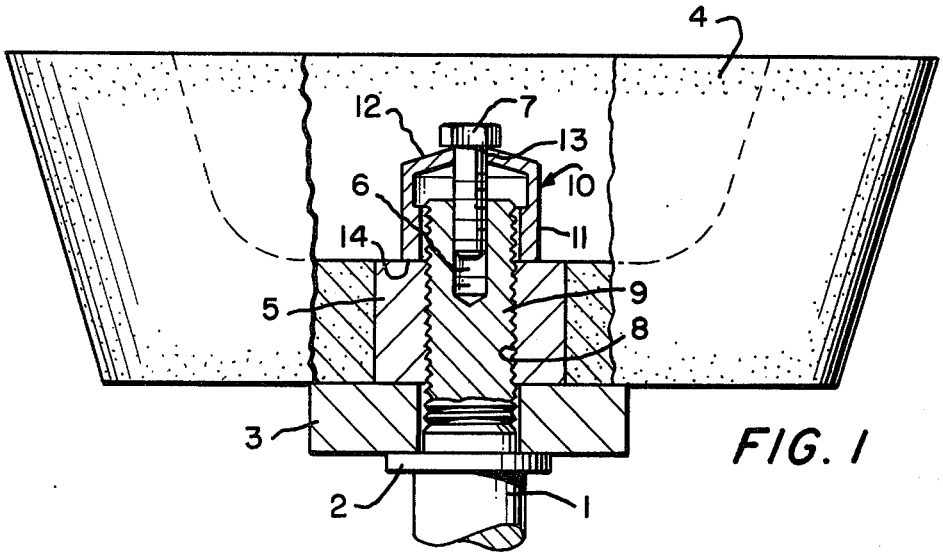
FIG. 1 shows a partial cross sectional view of a grinder spindle with a cup grinding wheel mounted thereon by means of the energy absorbing device according to this invention.
Figure 3:
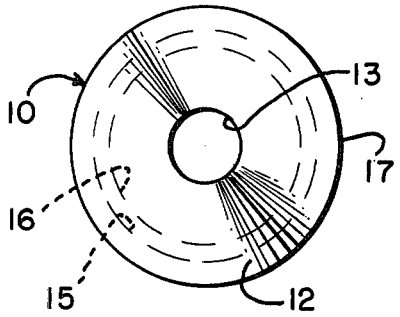
FIG. 3 shows a top view of the energy absorbing device in its initial form.

The energy absorbing device as shown on FIG. 1 is designed to absorb the energy from a rotating grinding wheel in the event of rapid deacceleration of the spindle in the event of a grinder failure resulting from, for example, vane breakage or bearing failure.

As shown in FIG. 1, the grinder spindle 1 is provided with a shoulder 2 for the purposes of providing a land for backup washer 3. Shown mounted on the spindle 1 is a typical cup grinding wheel 4 having a re-enforced cup wheel spindle insert (normally metallic) 5 which is provided with internal threads 8 which are in threaded engagement with external threads 9 on threaded spindle 1 and provides a true and re-enforced mounting portion for the cup wheel. The threaded spindle 1 is provided with a threaded counter bore 6, which in turn accepts retaining bolt 7.

The energy absorbing device according to this invention is shown mounted in its normal initial position surrounding the threaded spindle and attached thereto by means of retaining bolt 7. The energy absorbing device 10 is essentially in the form of hollow cylinder having a cylindrical side wall 11 with one end partially enclosed by a conical end plate 12. The conical end plate is provided with a bolt hole 13 through which the retaining bolt 7 passes.

As can be seen by one skilled in the art, the head of the retaining bolt 7 bears on the conical end plate 12, which in turn bears on the attached cylindrical side wall 11 of the energy absorbing device. The end of cylindrical side wall opposite the conical end plate forms a bearing surface 14 which bears on the cup wheel spindle insert. The wheel is retained in a relative position between the energy absorbing device 10 and backup washer 3.

The conical end plate 12 and at least a portion of the side wall of the cylindrical side wall 11 are formed of a sufficiently thin deformable material, such as metal.

Figure 2:
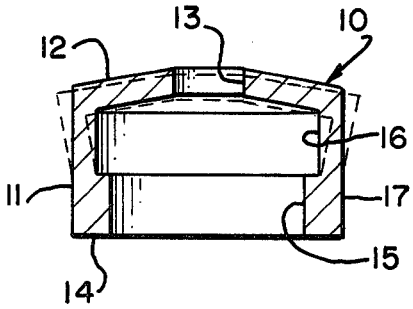
FIG. 2 shows a cross section of the energy absorbing device in both its initial and deformed (dotted) mode.

In practice, the cylindrical side wall may be stepped so as to provide two thickness, for example, in FIG. 2, the upper portion of the cylindrical side wall is shown as a reduced cross section having a first inside diameter 15 and a reduced inside diameter 16. The outside diameter 17 being held constant for this example. It should be understood that the relative thickness of both the conical end plate and the cylindrical side walls are chosen in accordance with the desired amount of stiffness and energy absorbing capacity required and may be readily determined by one skilled in the art by either calculation or experimentation for a particular application.

The first inside diameter is chosen so as to have the energy absorbing device fit concentrically about the threads 9 of the threaded spindle 1 with a reasonable sliding clearance. The outside diameter and the overall height of the energy absorbing device are thereafter determined by the stiffness required and the distance over which the energy is expected to be absorbed. The overall height of the energy absorbing device is, of course, limited in cup wheel applications from a design and economics standpoint to an exposure amount compatible with a worn cup wheel.

Figure 4:
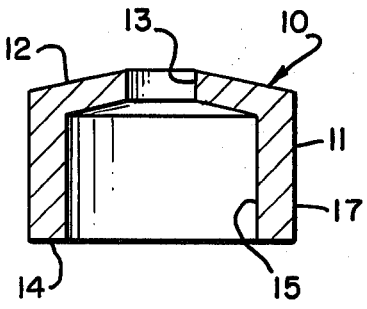
FIG. 4 is a cross sectional elevation showing an alternative construction of the energy absorbing device.

In operation, a sudden deacceleration of the threaded spindle will result in force being developed which tends to screw the cup wheel off the spindle due to the action of threads 8 and 9 acting as a power screw. The bolt 7 and the energy absorbing device 10 restrain the wheel on the spindle. However, the instantaneous force generated would be sufficient to destroy the mounting bolt 7 in the absence of the energy absorbing device 10. The energy absorbing device 10 absorbs the energy by deformation of the absorbing device as shown by dotted lines in FIG. 2. A different pitch is used on the mounting bolt relative to the wheel spindle thread as one means of ensuring the device will not dislodge itself. The mounting bolt has a thread pitch less than the pitch of the wheel spindle thread. The wheel energy absorption is accomplished by two-step action. First, the deformation of the top conical or belleville section of the device, and secondly the deformation of the cylindrical side walls resulting from the moment the end of the top belleville section places on the thin side wall. The two-step action offers a variety of energy absorbing levels which may be selected by varying the conical angle and wall sections (both conical and cylindrical). FIG. 4 shows a variation of the design wherein the side walls of the cylindrical portion are of sufficient thickness so as to essentially limit the deformation to the conical end plate portion 12. In this case, the energy absorption is accomplished in a single mode. Numerous other modifications will occur to one skilled in the art who will now understand my invention. I do not wish to be limited in the scope of my invention except as claimed.

I claim:

1. The combination of a grinding wheel which is mounted on the spindle of a grinder by means of mating threads and an energy absorbing device comprising:

a first cylindrical section;

a second conical section attached to and mounted in circumferential attachment at one end of said first cylindrical section;

said conical section being convex to said cylindrical portion;

said conical section being provided with a bolt hole through its apex for mounting to the spindle of said grinder;

a mounting bolt disposed through said bolt hole for engagement with an axial threaded bore in said grinder spindle; and said mounting bolt has a different pitch thread than the pitch of the thread mounting the grinding wheel on the grinder spindle.

2. The energy absorbing device according to claim 1 wherein:

said first cylindrical section comprises at least two sections of different wall thickness to provide a two-step level of energy absorption.

* * * * *